United States Patent [19]

Lew

[11] Patent Number: 4,724,655

[45] **Date of Patent: * Feb. 16, 1988**

[54] SANITARY RING PACKAGING

[76] Inventor: Jung G. Lew, 7890 Oak St., Arvada, Colo. 80005

[ * ] Notice: The portion of the term of this patent subsequent to May 6, 2003 has been disclaimed.

[21] Appl. No.: 857,768

[22] Filed: Apr. 30, 1986

Related U.S. Application Data

[63] Continuation-in-part of Ser. No. 931,774, Aug. 7, 1978, Pat. No. 4,586,742.

[51] Int. Cl.[4] ..... B65B 27/04; B65D 75/00; B65D 85/62

[52] U.S. Cl. ..... 53/398; 206/150; 294/87.2

[58] Field of Search ..... 53/398, 413, 427, 449, 53/48, 140, 141, 452; 206/150, 151, 497, 432; 294/87.2, 33; 220/87.2, 33

[56] References Cited

U.S. PATENT DOCUMENTS

| | | | |
|---|---|---|---|
| 3,046,711 | 7/1962 | Harrison | 53/398 |
| 3,137,109 | 6/1964 | Rapata | 53/48 |
| 3,355,013 | 11/1967 | Poupitch | 206/150 |
| 3,497,059 | 2/1970 | Watts, Jr. | 53/449 X |
| 3,601,439 | 8/1971 | Poupitch | 294/87.2 |
| 4,018,027 | 4/1977 | Curry et al. | 53/48 |
| 4,116,331 | 9/1978 | Curry et al. | 206/432 X |
| 4,121,712 | 10/1978 | Cunningham | 294/87.2 X |
| 4,281,502 | 8/1981 | Bonkowski | 53/398 |
| 4,586,742 | 5/1986 | Lew | 206/150 X |

*Primary Examiner*—Horace M. Culver

[57] ABSTRACT

This invention discloses a can packaging device that binds a plurality of cans together for easy handling and storage, and at the same time, covers the can tops for sanitary purpose. The sanitary ring packaging of the present invention is comprised of a thick plastic sheet including a plurality of substantially circular cut-outs wherein the edges of the thick plastic sheet are contoured to conform with the substantially circular cut-outs, and a thin plastic sheet superimposed on the thick plastic sheet with slack in the surface area wherein the thin plastic sheet is bonded to and clipped along the edges of the thick plastic sheet. The thick plastic sheet ties cans together which engage the substantially circular cut-outs or holes included therein in a tight and retaining relationship, while the thin plastic sheet covers the can tops.

13 Claims, 4 Drawing Figures

SANITARY RING PACKAGING

BACKGROUND OF THE INVENTION

This is a continuation-in-part application to patent application Ser. No. 931,774 entitled "Sanitary Ring Packaging" filed on Aug. 7, 1978, and now U.S. Pat. No. 4,586,742.

With few exceptions, soft drinks and beers in cans are sold in six-packs wherein six cans are bound together by a thick plastic sheet with six holes, which retains one extremity of the can as the plastic ring grabs one extremity of the can with a reduced diameter adjacent to the seam of the can lid having a slightly increased diameter. Although this type of six-pack packaging commonly known as "Hi-Cone" packaging is very popular as it provides a highly economic and very convenient method for carrying and storing a pack of cans, this packaging method fails to meet sanitary requirements. Most people drink directly from the can without washing the can tops. During transportation and storage, the can tops become contaminated by dusts and other particles settling on the can tops, which particles can include toxic materials such as insectcide sprayed in the warehouses or stores. In any event, the can tops in six-pack packaging are not clean enough as all kinds of particulate materials settle thereon and, consequently, it is not santiary to drink the content in the can directly from the can.

It is well known that the can tops can be covered with a thin plastic sheets with minimum expense as the price of the thin plastic sheet is almost nil. However, there is no technology available at the present time that installs the thin plastic sheets on top of the cans bound together by the plastic rings of thick plastic sheet, that results in neat and attractive packaging. As everyone in the commercial packaging industry is aware of, the acceptance or rejection of a packaging method by the consumers is determined ninety nine percent by the neatness and attractiveness of the packaging. There have been many attempts to develop a method for installing the thin plastic sheet covering can tops after cans are bound together by the plastic ring of thick plastic sheets, which method is called "post binding". All efforts geared to this "post binding" method have failed, for there is no way to neatly clip or trim the skirts of the thin plastic sheet that is "post-bound" to the plastic ring of the thick plastic sheet. Few inventors have even attempted to develope a method for binding the thin plastic sheet to the plastic rings of the thick plastic sheet, which method is called "pre-binding", for most experts in the art with few exceptions are aware that it is impossible to install the "pre-bound" combination of the thick plastic rings and thin plastic sheet over the cans because the metallic fingers of the packaging machine that engage and stretch the holes included in the plastic rings during the installation process cannot operate when the holes in the plastic rings are covered with the thin plastic sheets in the "pre binding" method. There is no can packaging available at the present time that covers the can tops in spite of the fact that there is a strong demand for such type can packaging by the consumers as well as by the regulatory agencies and that the additional cost for the thin plastic sheet covering the can top is extremely low, because there is no technology available to implement the new packaging concept commonly known as "covered six-packs".

The primary object of the present invention is to provide can packaging employing thick plastic rings binding cans together and a thin plastic sheet covering the can tops, wherein the thick plastic rings and thin plastic sheet are prebound to one another following the edges of the thick plastic rings prior to the installation thereof onto the cans being packaged.

Another object is to provide the pre-bound combination of the thick plastic rings and thin plastic sheets, that can be installed onto the cans by using the packaging machines employed in installing the present day open-top six pack plastic rings.

A further object is to provide an economic attractive and sanitary packaging method that not only ties the cans together but also covers the can tops, wherein there is no loose skirts of the thin plastic sheet, covering the can tops hanging over the edges of the thick plastic rings binding cans together.

These and other objects of the present invention will become clear as the description thereof proceeds.

BRIEF DESCRIPTION OF THE FIGURES

The present invention may be described with a great clarity and specificity by referring to the following figures.

DESCRIPTION OF THE ILLUSTRATED EMBODIMENTS

Figure 1:
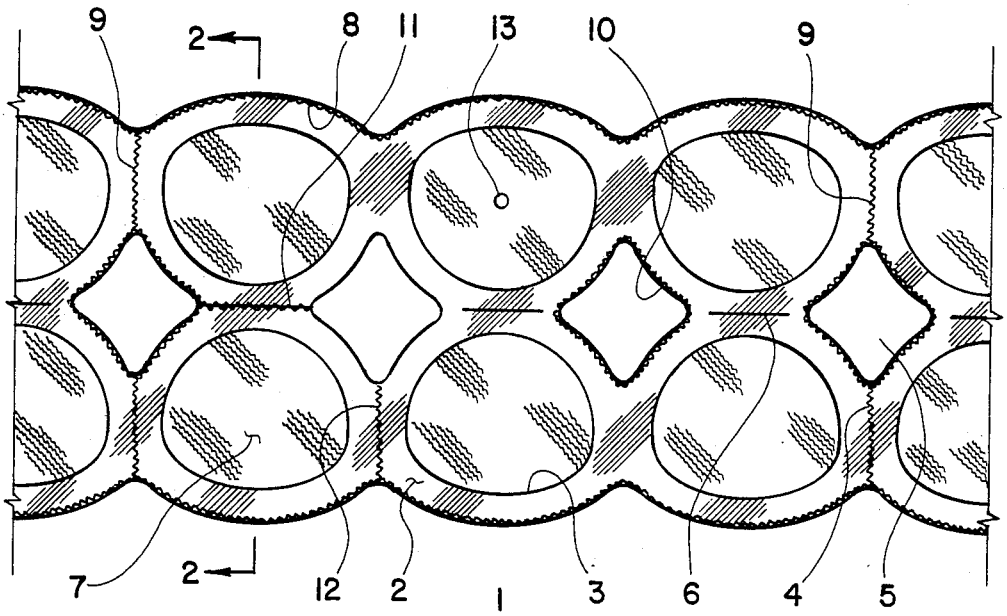
FIG. 1 illustrates a plan view of the sanitary ring packaging arranged in accordance with the principles of the present invention.
Figure 4:
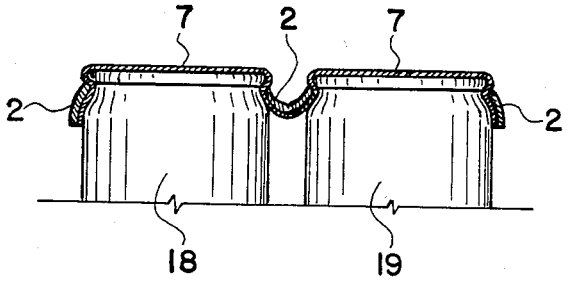
FIG. 4 illustrates a cross section of the sanitary ring packaging installed onto the cans.

In FIG. 1, there is illustrated a plan view of the sanitary ring packaging 1 arranged in accordance with the principles of the present invention, which comprises a thick plastic sheet 2 having a plurality of substantially circular holes 3 cut out therefrom, that has two lengthwise edges contoured to conform with the substantially circular cut-outs 3. The thick plastic sheet further includes a plurality of noncircular cut-outs 5 respectively disposed intermediate the substantially circular cut-outs wherein the shape of the noncircular cut-outs 20 is contoured to conform with the substantially circular cutouts 3. A thin plastic sheet 7 superimposed to the thick plastic sheet 2 having a slack in its surface area compared with the thick plastic sheet 2 is bonded to the thick plastic sheet 2 following the two lengthwise edges of the thick plastic sheet 2 and clipped therealong, whereby there are no skirts of the thin plastic sheet 7 overhanging beyond the edges of the thick plastic sheet 2. The combination of the thick plastic sheet 2 and the thin plastic sheet 7 bonded to one another along the two lengthwise edges can be provided by superimposing the two plastic sheets with a slack in the surface area of the thin plastic sheet 7 and then heat-cutting the lengthwise edges thereof by using hot roller discs or hot press knives, that provides clean and trim edges cut and bonded together as represented by the wavy lines 8 following the lengthwise edges of the combination of the thick and thin plastic sheets. The reason for providing a slack for the thin plastic sheet 7 in comparison with the thick plastic sheet 2 will become evident as the description of the present invention proceeds further. It should be understood that the bonding between the thick and thin plastic sheets 2 and 7 along the two lengthwise edges may be continuous or in the form of a stitch pattern of intermittent design. In general, the sanitary ring packaging 1 may be constructed in the form of a long strip, that can be separated into a plurality of short segments binding four, six, eight or twelve cans together after the sanitary ring packaging 1 is installed onto the cans. For an easy separation of the sanitary ring packaging strip into a plurality of finite segments, a plurality of stitch cuts 4 cut through both the thick and thin plastic sheets disposed intermediate the substantially circular cut-outs at a regualr interval in a direction across the length of the sanitary ring packaging strip 1 is provided. The stitch cuts 4 tear apart when a small amount of tension is applied in the lengthwise direction of the sanitary ring packaging strip 1. A series of linear indentations 6 is provided on the thick plastic sheet 1, that is disposed intermediate the substantially circular cut-outs in the lengthwise direction of the sanitary ring packaging strip 1 at a regualr interval. The thick plastic sheet 2 folds along the linear indentation 6 when the sanitary ring packaging strip 1 is installed on the cans as shown in FIG. 4, which enhances the tight grouping of the cans bound together by the sanitary ring packaging 1. The thick plastic sheet 2 and the thin plastic sheet 7 may be further bonded along the line of stitch cuts 4 as represented by the wavy lines 9, which bonding may be obtained by heat pressing along the line of stitch cuts 4. The thick and thin plastic sheets may be still further bonded to one another following the boundary of the noncircular cut-outs 5 as represented by the wavy lines 10. Such a bonding can be obtained automatically by heat cutting the noncircular cut-outs 5 through both thick and thin plastic sheets or heat pressing the noncircular cut-outs 5 through the thick plastic sheet 2 onto the thin plastic sheet 7. The thick and thin plastic sheets may also be bonded to one another along a line intermediate the circular cut-outs 3 as represented by the wavy lines 11 and 12. Often the can tops are wet during the packaging as a result of spray washing of the cans after they are filled. The covering of the can tops by the thin plastic sheet 7 traps the moisture, which can aid the growth of molds. A plurality of small openings 13 disposed through the thin plastic sheet 7, which are positioned within each circular cut-outs 3 allows the moisture to escape, while it provides only an insignificant passage for the dust that can settle on the can tops. A slitted opening may be employed in place of a plurality of small round holes 13.

Figure 2:
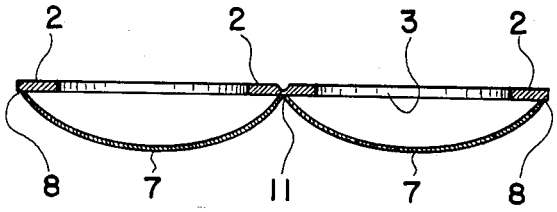
FIG. 2 illustrates a cross section of the sanitary ring packaging taken along plane 2—2 as shown in FIG. 1.
Figure 3:
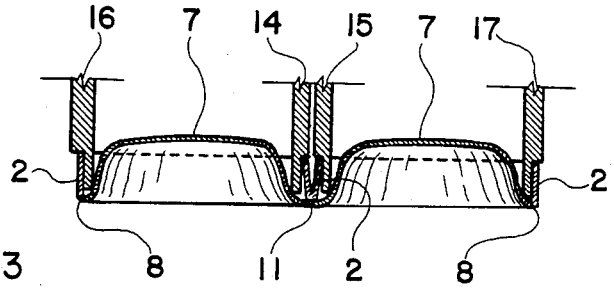
FIG. 3 illustrates a cross section of the sanitary ring packaging being readied for installation onto the cans.

In FIG. 2, there is illustrated a cross section of the sanitary ring packaging strip 1 taken along plane 2—2 as shown in FIG. 1. In this illustration, the lines of bonding 8, disposed along the two lengthwise edges and the line of bonding 11 disposed intermittently following the center line of the sanitary ring packaging strip 1 are clearly shown. It is also shown that the salck in the surface area of the thin plastic sheet 7 is provided as a result of the thin plastic sheet 7 having a greater width compared with the thick plastic sheet 2 is bonded thereto following the two lengthwise edges of the combination. The necessity of the slack in the surface area of the thin plastic sheet 7 in comparison with the thick plastic sheet 2 becomes evident when the FIGS. 3 and 4 are studied. In general, there must be a sufficinet area of the thin plastic sheet 7 within each substantially circular cut-outs 3 through the thick plastic sheet 2 in order to cover the extremity of the can engaging and extending into the substantially circular cut-out as illustrated in FIG. 4.

In FIG. 3 there is illustrated the same cross section of the sanitary ring packaging strip 1 as that shown in FIG. 2. The substantially circular cut-outs 7 are respectively engaged by a plurality of fingers 14 and 16, and 15 and 17, etc. belonging to the present day packaging machine installing the conventional plastic ring without the thin plastic covering can tops, which engages and extends through the substantially circular cut-outs 3 to such an extent that they stretch open the substantially circular cut-outs 3 without puncturing the thin plastic sheet 7. In order to facilitate the engagement of the substantially circular cut-outs 3 by the cans placed beneath the thin plastic sheet 7, an upward air jet or air stream may be employed to uplift the thin plastic sheet 7 through the substantially circular cut-outs 3. The now enlarged substantially curcular cut-outs 3 can readily be inserted over the top extremity of the cans and the installing fingers 14, 15, 16 and 17 can be retracted as the seam of the can lid catches and retains the rim of the substantially circular cut-outs 3.

In FIG. 4 there is illustrated the same cross section of the sanitary ring packaging strip 1 as those shown in FIGS. 2 and 3, which is now installed on the cans 18, 19, etc. It is clearly shown that the plurality of the cans are bound together by the thick plastic sheet 2 while the can tops are covered by the thin plastic sheet 7. It should be understood that the present invention provides sanitary can packaging wherein the can tops are covered by the thin plastic sheet neatly and attractively bonded to the thick plastic sheet binding cans together without leaving loose or crumpled skirts of the thin plastic sheet hanging over the boundaries of the thick plastic sheet.

While the principles of the present invention have now been made clear by the illustrative embodiments there will be immediately obvious to those skilled in the art many modification of the structures, arrangement, porportions, elements, materials and components used in the practice of the invention which are particularly adapted for specific working environments and operating conditions without departing from those principles.

I claim:

1. A sanitary ring packaging strip for binding cans together and covering can tops comprising in combination:

(a) an elongated thick plastic sheet having a plurality of substantially circular cut-outs disposed in a pattern of multiple rows wherein two edges of said elongated thick plastic sheet are contoured to conform with said substantially circular cut-outs, said elongated thick plastic sheet further including a plurality of noncircular cut-outs respectively disposed intermediate said substantially circular cut-outs wherein the boundary of said noncircular cut-outs is contoured to conform with said substantially circular cut-outs; and (b) an elongated thin plastic sheet superimposed to said elongated thick plastic sheet wherein a slack is provided in the surface area of said elongated thin plastic sheet in comparison with said elongated thick plastic sheet, two edges of said elongated thin plastic sheet respectively contoured to conform with and bonded to the two edges of said elongated thick plastic sheet wherein bonding of said elongated thick and thin plastic sheets following the two edges are made prior to the installation of said sanitary ring packaging strip onto a plurality of cans;

wherein ring opening fingers of a packaging machine are allowed to engage and extend through said substantially circular cut-outs to an extent wherein the ring opening fingers stretch open said substantially circular cut-outs without puncturing said elongated thin plastic sheet in the process of inserting one extremity of each can into said substantially circular cut-outs, whereby said sanitary ring packaging strip provides a plurality of cans bound together by said elongated thick plastic sheet and can tops covered with said elongated thin plastic sheet.

2. The combination as set forth in claim 1 wherein said elongated thick plastic sheet and said elongated thin plastic sheet is further bonded to one another following center line of said sanitary ring packaging strip wherein a slack for said elongated thin plastic sheet is provided for each half of said elongated thin plastic sheet divided by said center line.

3. The combination as set forth in claim 1 wherein a series of stitch cuts is included intermediate said substantially circular cut-outs in a direction substantially perpendicular to the length of said sanitary ring packaging strip at a regualr interval.

4. The combination as set forth in claim 2 wherein a series of stitch cuts is included intermediate said substantially circular cut-outs in a direction substantially perpendicular to the length of said sanitary ring packaging strip at a regualr interval.

5. The combination as set forth in claim 1 wherein at least one small opening through said elongated thin plastic sheet is provided for each of said substantially circular cut-outs.

6. The combination as set forth in claim 2 wherein at least one small opening through said elongated thin plastic sheet is provided for each of said substantially circular cut-outs.

7. The combination as set forth in claim 3 wherein at least one small opening through said elongated thin plastic sheet is provided for each of said substantially circular cut-outs.

8. The combination as set forth in claim 4 wherein at least one small opening through said elongated thin plastic sheet is provided for each of said substantially circular cut-outs.

9. The combination as set forth in claim 3 wherein said elongated thick and thin sheets are further bonded to one another following said stitch cuts.

10. The combination as set forth in claim 9 wherein at least one small opening through said elongated thin plastic sheet is provided for each of said substantially circular cut-outs.

11. The combination as set forth in claim 4 wherein said elongated thick and thin sheets are further bonded to one another following stitch cuts.

12. The combination as set forth in claim 11 wherein at least one small opening through said elongated thin plastic sheet is provided for each of said substantially circular cut-outs.

13. A process for implementing sanitary packaging wherein a plurality of cans are bound together by a thick plastic sheet including a plurality of substantially circular holes and can tops are covered by a thin plastic sheet bonded to said thick plastic sheet along edges of said thick plastic sheet prior to the installation of said combination of thick and thin plastic sheets onto the cans, said process inlcuding in combination:

(a) a first step including the bonding of an elongated thick plastic sheet and an elongated thin plastic sheet to one another following at least two edges of said elongated thick plastic sheet, said elongated thick plastic sheet having a plurality of substantially circular cut-outs disposed in a pattern of multiple rows wherein two edges of said elongated thick plastic sheet are contoured to conform with said substantially circular cut-outs, said elongated thick plastic sheet further including a plurality of noncircular cut-outs respectively disposed intermediate said substantially circular cut-outs wherein the boundary of said noncircular cut-outs is contoured to conform with said substantially circular cut-outs; and said elongated thin plastic sheet superimposed to said elongated thick plastic sheet wherein slack is provided in the surface area of said elongated thin plastic sheet in comparison with said elongated thick plastic sheet, two edges of said elongated thin plastic sheet respectively contoured to conform with and bonded to the two edges of said elongated thick plastic sheet, wherein bonding of said elongated thick and thin plastic sheets following at least the two edges are made prior to the installation of said combination of said elongated thick and thin plastic sheets onto a plurality of cans;

(b) a second step including enlarging of said substantially circular cut-outs by stretching action provided by a plurality of mechanical fingers engaging and extending through said substantially circular cut-outs to an extent wherein said elongated thin plastic sheet now disposed intermediate said plurality of mechanical fingers and a plurality of cans is not punctured;

(c) a third step including insertion of cans into now enlarged said substantially circular cut-outs thrusting the extremities of the cans now covered by said elongated thin plastic sheet; and (d) a fourth step including reducing of said substantially circular cut-outs by relaxing said enlarging action provided by said mechanical fingers until rims of said substantially circular cut-outs become retained by seams of can lids, and withdrawing said plurality of mechanical fingers from said plurality of said substantially circular cut-outs; and (e) a fifth step including separation of a finite length of said combination of said elongated thick and thin plastic sheets now binding a plurality of cans and covering can tops from remainder of said combination of said elongated thick and thin plastic sheets.

* * * * *